US007934410B2

(12) United States Patent
Myers et al.

(10) Patent No.: US 7,934,410 B2
(45) Date of Patent: May 3, 2011

(54) EXPANDING DIE AND METHOD OF SHAPING CONTAINERS

(75) Inventors: Gary L. Myers, Sarver, PA (US); Anthony Fedusa, Lower Burrell, PA (US); Robert E. Dick, Cheswick, PA (US)

(73) Assignee: Alcoa Inc., Pittsburgh, PA (US)

( * ) Notice: Subject to any disclaimer, the term of this patent is extended or adjusted under 35 U.S.C. 154(b) by 226 days.

(21) Appl. No.: 11/474,581

(22) Filed: Jun. 26, 2006

(65) Prior Publication Data

US 2007/0295051 A1 Dec. 27, 2007

(51) Int. Cl.
*B21D 22/21* (2006.01)
*B21D 22/00* (2006.01)
*B21D 51/00* (2006.01)

(52) U.S. Cl. ..... 72/348; 72/356; 72/370.06; 413/69

(58) Field of Classification Search ..... 72/379.4, 72/348, 370.06, 370.1, 370.11, 370.12, 370.13, 72/352, 355.4, 356, 715; 413/69, 76
See application file for complete search history.

(56) References Cited

U.S. PATENT DOCUMENTS 3,759,205 A * 9/1973 Dolveck ..... 72/370.02
3,857,917 A * 12/1974 Reade ..... 264/560
3,898,828 A 8/1975 Cassai et al.
3,995,572 A 12/1976 Saunders
4,163,380 A 8/1979 Masoner
4,173,883 A 11/1979 Boik
4,947,667 A 8/1990 Gunkel et al.
5,040,682 A 8/1991 Palisin, Jr. et al.
5,058,408 A 10/1991 Leftault, Jr. et al.
5,160,031 A 11/1992 Palisin, Jr. et al.
5,261,558 A 11/1993 Claydon
5,351,852 A 10/1994 Trageser et al.
5,355,710 A 10/1994 Diekhoff
5,394,727 A 3/1995 Diekhoff et al.
5,470,405 A 11/1995 Wyatt-Mair et al.
5,487,295 A 1/1996 Diekhoff et al.
5,522,248 A 6/1996 Diekhoff et al.
5,572,893 A 11/1996 Goda et al.
5,645,190 A 7/1997 Goldberg
5,699,932 A 12/1997 Claydon et al.
5,711,178 A * 1/1998 Hogendoorn et al. ..... 72/352
(Continued)

FOREIGN PATENT DOCUMENTS

AR 060964 10/2010
(Continued)

OTHER PUBLICATIONS

U.S. Office Action dated Mar. 17, 2008 from U.S. Appl. No. 11/768,267.

(Continued)

*Primary Examiner* — Debra M Sullivan
(74) *Attorney, Agent, or Firm* — Greenberg Traurig, LLP

(57) ABSTRACT

The present invention provides an expansion die for manufacturing containers including a work surface including a progressively expanding portion and a land portion; and an undercut portion positioned following the land portion of the work surface. The present invention further provides a process for manufacturing shaped containers including providing a container stock having a first diameter; expanding at least a portion of the container stock to a second diameter with at least one expansion die; and forming an end of the container stock to accept a container lid.

11 Claims, 6 Drawing Sheets

U.S. PATENT DOCUMENTS

| | | | | |
|---|---|---|---|---|
| 5,713,235 | A | 2/1998 | Diekhoff | |
| 5,724,848 | A | 3/1998 | Aschberger | |
| 5,727,414 | A | 3/1998 | Halasz et al. | |
| 5,746,080 | A | 5/1998 | Hartman et al. | |
| 5,755,130 | A | 5/1998 | Tung et al. | |
| 5,776,270 | A | 7/1998 | Biondich | |
| 5,822,843 | A | 10/1998 | Diekhoff et al. | |
| 5,832,766 | A | 11/1998 | Hartman et al. | |
| 5,851,685 | A | 12/1998 | McEldowney | |
| 5,899,104 | A | 5/1999 | Brilman et al. | |
| 5,899,105 | A | 5/1999 | Erhard | |
| 5,899,106 | A | 5/1999 | Heurteboust et al. | |
| 5,902,086 | A | 5/1999 | Enoki | |
| 5,916,317 | A | 6/1999 | Willoughby et al. | |
| 5,938,389 | A | 8/1999 | Shore et al. | |
| 5,960,659 | A | 10/1999 | Hartman et al. | |
| 5,970,767 | A | 10/1999 | Hartman et al. | |
| 6,038,910 | A | 3/2000 | McClung | |
| 6,079,244 | A | 6/2000 | Robinson et al. | |
| 6,085,563 | A | 7/2000 | Heiberger et al. | |
| 6,112,932 | A | 9/2000 | Holdren | |
| D435,454 | S | 12/2000 | Munn et al. | |
| 6,250,122 | B1 | 6/2001 | Robinson et al. | |
| 6,286,357 | B1 | 9/2001 | D'Amore et al. | |
| 6,308,545 | B2 | 10/2001 | Burgel et al. | |
| 6,338,263 | B1 | 1/2002 | Obata et al. | |
| 6,343,496 | B1 | 2/2002 | Hanna et al. | |
| D455,961 | S | 4/2002 | Edson et al. | |
| 6,374,657 | B1 | 4/2002 | Kirk et al. | |
| 6,442,991 | B1 * | 9/2002 | Rojek | 72/352 |
| D464,264 | S | 10/2002 | Edson et al. | |
| 6,701,764 | B2 | 3/2004 | Bruck et al. | |
| D490,317 | S | 5/2004 | Chang | |
| 6,779,677 | B2 | 8/2004 | Chupak | |
| 6,802,196 | B2 | 10/2004 | Gong et al. | |
| 6,886,722 | B2 | 5/2005 | Flecheux | |
| 6,907,653 | B2 | 6/2005 | Chupak | |
| 6,945,085 | B1 | 9/2005 | Goda | |
| D512,315 | S | 12/2005 | Holm | |
| D514,937 | S | 2/2006 | Chang | |
| 7,003,999 | B2 | 2/2006 | Campo et al. | |
| 7,004,000 | B2 | 2/2006 | Campo et al. | |
| 7,188,499 | B2 | 3/2007 | Ogaki et al. | |
| 7,670,094 | B2 | 3/2010 | Bolthauser | |
| 7,726,165 | B2 | 6/2010 | Myers et al. | |
| 2001/0022103 | A1 * | 9/2001 | Zeiter et al. | 72/347 |
| 2001/0040167 | A1 | 11/2001 | Flecheux et al. | |
| 2002/0162371 | A1 | 11/2002 | Hamstra et al. | |
| 2003/0074946 | A1 | 4/2003 | Campo et al. | |
| 2003/0102278 | A1 | 6/2003 | Chupak | |
| 2003/0115923 | A1 | 6/2003 | Veen et al. | |
| 2004/0011112 | A1 | 1/2004 | Lentz et al. | |
| 2004/0035871 | A1 | 2/2004 | Chupak | |
| 2004/0040970 | A1 | 3/2004 | Weijers et al. | |
| 2004/0187536 | A1 | 9/2004 | Gong et al. | |
| 2004/0194522 | A1 | 10/2004 | Hamstra et al. | |
| 2004/0216506 | A1 * | 11/2004 | Simpson et al. | 72/370.06 |
| 2004/0231395 | A1 * | 11/2004 | Barber | 72/370.06 |
| 2005/0000260 | A1 | 1/2005 | Campo et al. | |
| 2005/0193796 | A1 | 9/2005 | Heiberger et al. | |
| 2005/0235726 | A1 | 10/2005 | Chupak | |
| 2006/0071035 | A1 | 4/2006 | Christ et al. | |
| 2007/0266758 | A1 * | 11/2007 | Myers et al. | 72/379.4 |
| 2007/0271993 | A1 | 11/2007 | Druesne et al. | |
| 2008/0022746 | A1 | 1/2008 | Myers et al. | |
| 2008/0116212 | A1 | 5/2008 | Jonker | |
| 2009/0274957 | A1 | 11/2009 | Goda et al. | |
| 2010/0199741 | A1 | 8/2010 | Myers et al. | |

FOREIGN PATENT DOCUMENTS

| | | |
|---|---|---|
| AU | 2007254362 | 12/2010 |
| CL | 2234-96 | 12/1996 |
| DE | 4113428 | 10/1992 |
| EP | 492861 | 7/1992 |
| EP | 599583 | 6/1994 |
| EP | 721384 | 8/1994 |
| EP | 767241 | 4/1997 |
| EP | 845315 | 6/1998 |
| EP | 852973 | 7/1998 |
| EP | 852974 | 7/1998 |
| EP | 854823 | 7/1998 |
| EP | 1064413 | 1/2001 |
| EP | 0853513 | 8/2001 |
| EP | 928229 | 8/2001 |
| EP | 0853514 | 10/2001 |
| EP | 0853515 | 10/2001 |
| EP | 1294622 | 3/2003 |
| EP | 1506824 | 2/2005 |
| EP | 1461262 | 2/2007 |
| EP | 1586393 | 9/2007 |
| EP | 2111935 | 10/2009 |
| FR | 2495507 | 6/1982 |
| FR | 2762383 | 10/1998 |
| ID | P0026760 | 10/2010 |
| JP | 07242226 | 9/1995 |
| JP | 2000015371 | 1/2000 |
| WO | 91/11274 | 8/1991 |
| WO | 91/11275 | 8/1991 |
| WO | 91/14626 | 10/1991 |
| WO | 93/22079 | 11/1993 |
| WO | 95/05253 | 2/1995 |
| WO | 95/15227 | 6/1995 |
| WO | 96/15865 | 5/1996 |
| WO | 96/25256 | 8/1996 |
| WO | 96/40457 | 12/1996 |
| WO | 97/11889 | 4/1997 |
| WO | 97/12704 | 4/1997 |
| WO | 97/12705 | 4/1997 |
| WO | 97/12706 | 4/1997 |
| WO | 97/47408 | 12/1997 |
| WO | 98/05445 | 2/1998 |
| WO | 98/39117 | 9/1998 |
| WO | 98/43757 | 10/1998 |
| WO | 99/32242 | 7/1999 |
| WO | 99/37826 | 7/1999 |
| WO | 01/51231 | 7/2001 |
| WO | 01/58618 | 8/2001 |
| WO | 01/96209 | 12/2001 |
| WO | 03/039975 | 5/2003 |
| WO | 03/047991 | 6/2003 |
| WO | 2004/058597 | 7/2004 |
| WO | 2005000498 | 1/2005 |
| WO | 2005/099926 | 10/2005 |
| WO | 2006/040116 | 4/2006 |
| WO | 2006/078690 | 7/2006 |
| WO | 2008/110679 | 9/2008 |
| WO | 2009/130034 | 10/2009 |
| ZA | 2008/10096 | 12/2009 |

OTHER PUBLICATIONS

U.S. Office Action dated Oct. 9, 2008 from U.S. Appl. No. 11/768,267.

U.S. Office Action dated May 14, 2009 from U.S. Appl. No. 11/768,267.

U.S. Office Action dated Apr. 17, 2007 from U.S. Appl. No. 11/383,515.

U.S. Office Action dated Sep. 5, 2007 from U.S. Appl. No. 11/383,515.

U.S. Office Action dated Apr. 28, 2008 from U.S. Appl. No. 11/383,515.

U.S. Office Action dated Dec. 29, 2008 from U.S. Appl. No. 11/383,515.

U.S. Office Action dated Jul. 21, 2009 from U.S. Appl. No. 11/383,515.

Malaysian Office Action from corresponding Malaysian Application No. PI 20085325 dated Sep. 4, 2009.

Chilean Office Action from Chilean Application No. 1401-07 dated Feb. 13, 2009.

New Zealand Office Action from corresponding New Zealand Application No. 574204 dated Jun. 17, 2010.

New Zealand Office Action from corresponding New Zealand Application No. 574797 dated Jun. 17, 2010.

U.S. Office Action dated Sep. 1, 2010 from U.S. Appl. No. 12/767,190.

Malaysian Office Action dated Nov. 13, 2009 from Malaysian Application No. PI20085324.
Eurasian Office Action dated Dec. 15, 2009 from Eurasian Application No. 200870536.
European Office Action dated Jan. 8, 2010 from European Application No. 077770352.
Chinese Office Action dated Jan. 22, 2010 from Chinese Application No. 2007800239167.
Chinese Office Action dated Jan. 22, 2010 from Chinese Application No. 2007800242507.
U.S. Office Action dated Jan. 27, 2010 from U.S. Appl. No. 11/768,267.
Chinese Office Action dated Feb. 12, 2010 from Chinese Application No. 2007800241862.
Australian Office Action dated Mar. 31, 2010 from Australian Application No. 2007254362.
Egyptian Office Action dated Mar. 16, 2010 from Egyptian Application No. 2008122088.
Indonesian Office Action dated Mar. 22, 2010 from Indonesian Application No. W-00200804206.
Canadian Office Action dated Apr. 7, 2010 from Canadian Application No. 2651778.
Canadian Office Action dated Apr. 13, 2010 from Canadian Application No. 2655908.
Canadian Office Action dated Apr. 15, 2010 from Canadian Application No. 2655925.
Indonesian Office Action dated Apr. 16, 2010 from Indonesian Application No. W-00200803711.
New Zealand Office Action dated Apr. 30, 2010 from New Zealand Application No. 573303.
European Office Action dated May 5, 2010 from European Application No. 07799029.9.
European Office Action dated May 5, 2010 from European Application No. 07797928.4.
Australian Office Action May 10, 2010 from Australian Application No. 2007265132.
Australian Office Action dated May 10, 2010 from Australian Application No. 2007265347.
Egyptian Office Action dated Jun. 2, 2010 from Egyptian Application No. 2008/122030.

* cited by examiner

EXPANDING DIE AND METHOD OF SHAPING CONTAINERS

FIELD OF THE INVENTION

This invention relates to expansion dies for shaping beverage containers.

BACKGROUND OF THE INVENTION

Beverage containers for various soft drinks or beer are generally formed by drawn and iron technology (i.e., the DI can), in which the container trunk (or side wall portion) and the container bottom are integrally formed by drawing and ironing a metallic sheet, such as an aluminum alloy sheet or a surface-treated steel sheet.

In the industry, these beverage containers are produced massively and relatively economically to substantially an identical shape. As the containers are produced substantially to an identical shape, they can not adequately be discriminated or differentiated from one another by their appearance. As the beverage containers are manufactured massively and relatively economically, there is a strong desire among beverage manufacturers for economical beverage containers with unique configurations to help differentiate their products.

In an effort to satisfy the desires of the beverage manufacturers, many containers manufacturers have been trying to add improvements to their manufacturing technology and a number of processes for reshaping the container bodies have been proposed to date. One example of a prior reshaping process that produces a container body having an increased diameter includes molding technology in combination with an expansion medium that is positioned within the container body. The expansion medium causes a radial expansion of the container body from its interior against a mold surface having a geometry that corresponds to the desired shape. The expansion medium may include compressed air or nitrogen; an incompressible liquid; or may be provided by radially actuated fingers.

Reshaping or expansion of container bodies by molding technology has a number of disadvantages. More specifically, molding of container bodies increases manufacturing time and hence the cost associated with producing the beverage containers. Molding is not easily incorporated into an inline process, therefore requiring that the molding step be separate from the in line process of forming container bodies using drawn and iron technology.

A further disadvantage is that the degree of expansion that may be provided using molding is substantially limited, especially when taking into account that drawn and ironed cans have undergone intensive metal working, i.e., drawing and ironing operations, and may no longer retain adequate ductility so that a conspicuous contour to give the desired effects is attainable without resulting in rupture of the can or metal fracture. In one example, an aluminum body container having a wall thickness on the order of approximately 0.0040", can only be radially expanded by a maximum of 10% of the container body's original diameter using a single molding step.

In light of the above, a need exists to provide a more economic method of providing beverage containers having an expanded diameter portion, wherein the method is easily incorporated into an in-line process.

SUMMARY OF THE INVENTION

Generally speaking, in accordance with the invention, a process for manufacturing a shaped container with a sidewall having at least one expanded diameter portion is provided, in which the expanded portion is provided by at least one expansion die.

The method including:

providing a container stock having a first diameter;

expanding at least a portion of the container stock to a second diameter with at least one expansion die; and forming an end of the container stock to accept a container lid.

The expansion die is insertable into the open end of a container stock, wherein the work surface of the expansion die progressively diverges from the expansion die's centerline. As the expansion die is inserted into the open end of the container stock, the work surface of the expansion die deforms the container stock's sidewalls radially to provide an expanded diameter portion.

In one embodiment, the method may further include necking the container stock with at least one necking die to a third diameter following the expansion step and prior to the step of forming of the end of the container stock to accept the container lid.

In one embodiment, the method may further include the step of adjusting the travel dimension of the container stock into the necking die and/or the expansion die to provide a minimized transition between an expanded portion of the container and a necked portion of the container or an elongated transition of substantially uniform diameter between the expanded portion and the necked portion of the container.

In another aspect of the present invention, an expansion die is provided for manufacturing metal containers with a radially expanded diameter. The expansion die includes a work surface having a progressively expanding portion and a land portion; and an undercut portion positioned following the land portion of the work surface. The initial portion of the work surface has a geometry for forming the transition in a container body sidewall from the original diameter portion to an expanded diameter portion.

In another aspect of the present invention, a die system is provided including the above described expansion die for providing a shaped container having at least one radially expanded diameter portion. The die system including:

a first expansion die having a work surface configured to increase a container stock diameter and to determine a profile at a transition from an original container stock diameter to an expanded portion of the container stock, and at least one progressive expansion die, wherein each successive die of the at least one progressive expansion die has a working surface configured to provide an equal, less than, or increasing degree of expansion in the container stock diameter from the first expansion die.

BRIEF DESCRIPTION OF THE DRAWINGS

The following detailed description, given by way of example and not intended to limit the invention solely thereto, will best be appreciated in conjunction with the accompanying drawings, wherein like reference numerals denote like elements and parts, in which.

DETAILED DESCRIPTION OF PREFERRED EMBODIMENTS

Figure 1A:
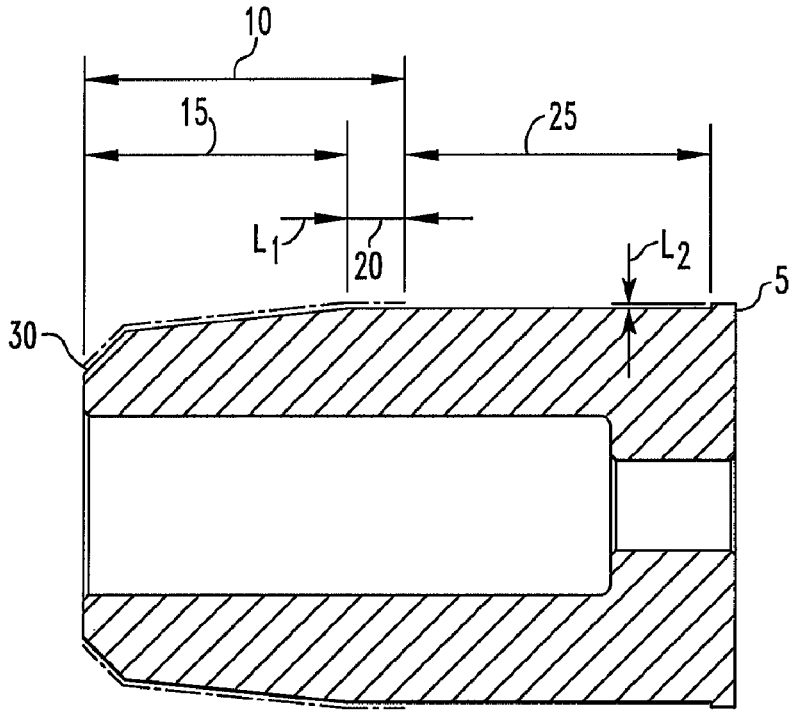
FIG. 1A is a side cross sectional view of one embodiment of an expansion die, in accordance with the present invention.

FIGS. 1A-1D depict an expansion die 5 used to provide a shaped beverage container having at least one expanded portion, in which the diameter of the beverage container is expanded radially. Preferably, the shaped beverage container may be generally of a beverage can geometry or may generally have the geometry of beverage bottle, but other geometries have been contemplated and are within the scope of the present invention. Preferably, the beverage container is formed from a metal, more preferably being an aluminum alloy, such as Aluminum Association (AA) 3104.

The expansion die 5 of the present invention includes a work surface 10 including a progressively expanding portion 15 and a land portion 20; and an undercut portion 25 positioned following the land portion 20 of the work surface 10. The initial portion 30 of the work surface 10 has a geometry for forming a transition in a container sidewall from an original diameter portion to an expanded diameter portion.

In one embodiment, an expansion die 5 is provided as illustrated in FIG. 1A, in which the initial portion 30 of the work surface 10 has an angle configured to provide a smooth transition between the container's original diameter and the expanded portion of the container sidewall, in which the container's diameter is increased radially. Examples of beverage containers having a smooth transition are illustrated in Examples A, B, C, D, and E of FIG. 2A, and Example K of FIG. 2C, which illustrate some embodiments of a 2.069" internal diameter beverage can (beverage container) having at least one portion with a diameter expanded to greater than the diameter of a 211 beverage can having an internal diameter equal to 2.603". For the purposes of this disclosure the term smooth transition denotes a gradual increase in diameter. In one preferred embodiment, an expansion die 5 having a work surface 10 to produce a smooth transition is provided to produce a container having a geometry similar to a pilsner glass.

Figure 1B:
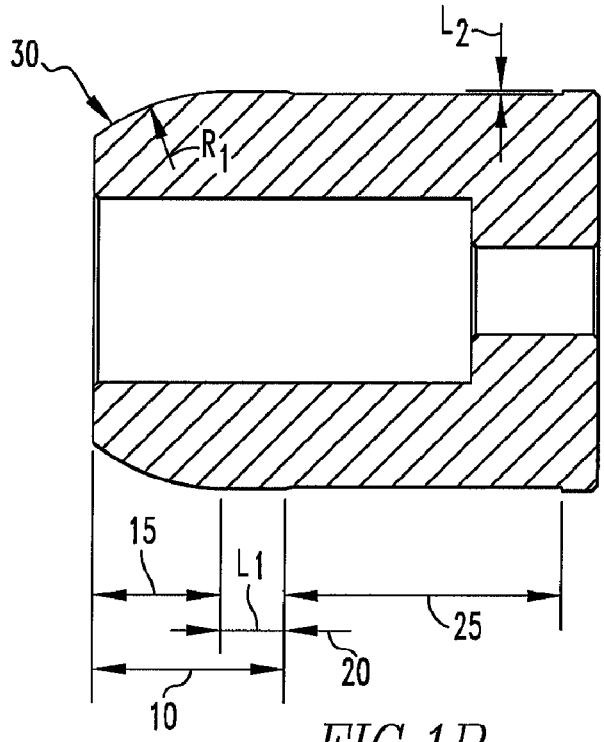
FIG. 1B is a side cross sectional view of another embodiment of an expansion die, in accordance with the present invention.
Figure 1C:
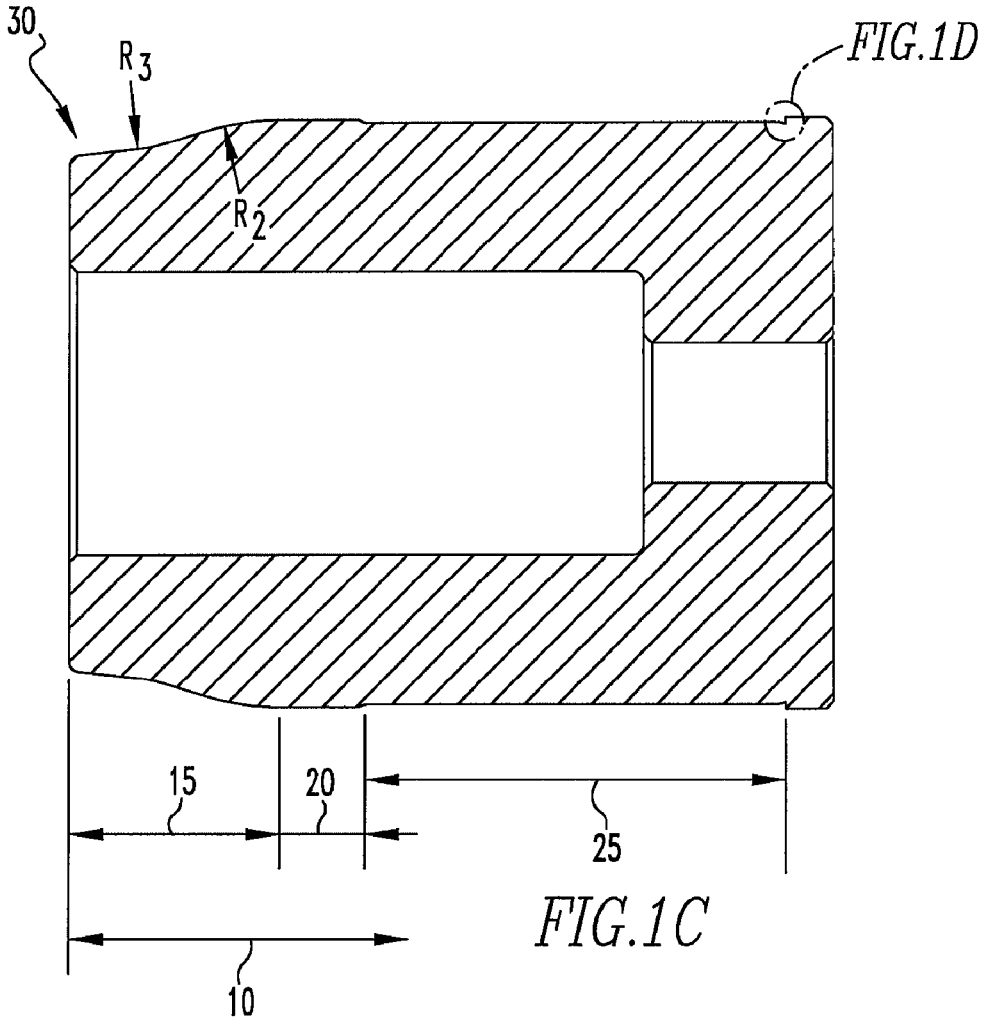
FIG. 1C is a side cross sectional view of another embodiment of an expansion die, in accordance with the present invention.

In another embodiment, an expansion die 5 is provided as illustrated in FIGS. 1B and 1C, in which the initial portion 30 of the work surface 10 has a curvature configured to provide a more pronounced or stepped transition between the container's original diameter and the expanded portion of the container, in which the container's diameter is increased radially. In one embodiment, the curvature of the initial portion 30 of the work surface 10 may be provided by a single radii R1. In another embodiment, the curvature of the initial portion 30 of the work surface 10 may be provided by two opposing radii R2, R3 in a manner that produces the desired expansion in providing a sidewall with a pronounced or stepped transition. Examples of beverage containers having a pronounced or stepped transition are illustrated in Examples G, H, I, and J of FIGS. 2B, and Examples L, M, and N of FIG. 2C, which illustrate some embodiments of a 2.069" internal diameter beverage can (beverage container) having at least one portion with a diameter expanded to greater than the diameter of a 211 beverage having an internal diameter equal to 2.603". For the purposes of this disclosure, the term "pronounced or stepped transition" denotes a more abrupt increase in diameter that may include a ripple effect to the container's sidewall.

The work surface 10 of the expansion die 5 further includes a progressively expanding portion 15 which may include the initial portion 30. The progressively expanding portion 15 has dimensions and a geometry that when inserted into the open end of a can stock works the can stock's sidewall to radially expand the can stock's diameter in a progressive manner as the stock travels along the work surface 10. The degree of expansion may be dependent on the desired final diameter of the container's expanded portion, on the number of expanding dies utilized to form the expanded portion, as well as the material and wall thickness of the container stock. In one embodiment, the work surface 10 may provide the appropriate expansion and forming operations without the need of a knockout or like structure.

The work surface 10 of the expansion die 5 further includes a land portion 20 at the conclusion of the progressively expanding portion 15. The land portion 20 has dimensions and a geometry for setting the final diameter of the expanded portion of the container being formed by that expanding die 5. In one embodiment, the land portion 20 may extend along the necking direction by a distance L1 being less than 0.5", preferably being on the order of approximately 0.125". It is noted that the dimensions for the land portion 20 are provided for illustrative purposes only and are not deemed to limit the invention, since other dimensions for the land portion 20 have also been contemplated and are within the scope of the disclosure.

The work surface 10 may be a polished surface or a non-polished surface. In one embodiment, a polished surface has a surface roughness average (Ra) finish ranging from 2μ in to 6μ in. In one embodiment, the work surface 10 may be a non-polished surface having a surface roughness average (Ra) ranging from more than or equal to 8μ in to less than or equal to 32μ in, so long as the non-polished surface 10 does not significantly degrade the product side coating disposed along the container stock's inner surface.

Figure 1D:
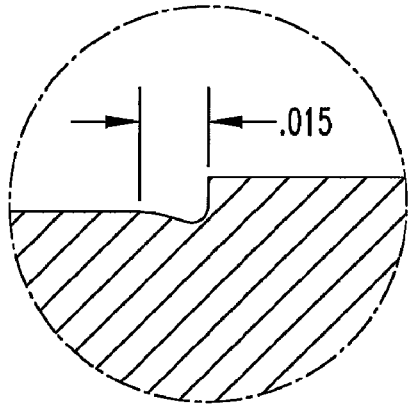
FIG. 1D is a magnified cross sectional view of the undercut depicted in FIGS. 1A, 1B and 1C.

Following the land portion 20 is an undercut portion 25 configured to reduce the frictional contact between the container stock and the expansion die 5, as the container stock has been worked through the progressive expanding portion 15 and land 20 of the working surface 10. FIG. 1D depicts a magnified view of the end of one embodiment of an undercut portion 25, in accordance with the present invention. The reduced frictional contact minimizes the incidence of collapse and improves stripping of the container stock during the expansion process. In a preferred embodiment, the undercut portion 25 is a non-polished surface having a surface roughness average (Ra) ranging from more than or equal to 8μ in to less than or equal to 32μ in. The under cut portion 25 may extend into the expanding die wall by a dimension L2 of at least 0.005 inches. It is noted that the dimensions and surface roughness values for the undercut portion 25 are for illustrative purposes only and that the present invention is not deemed to be limited thereto.

Figure 4:
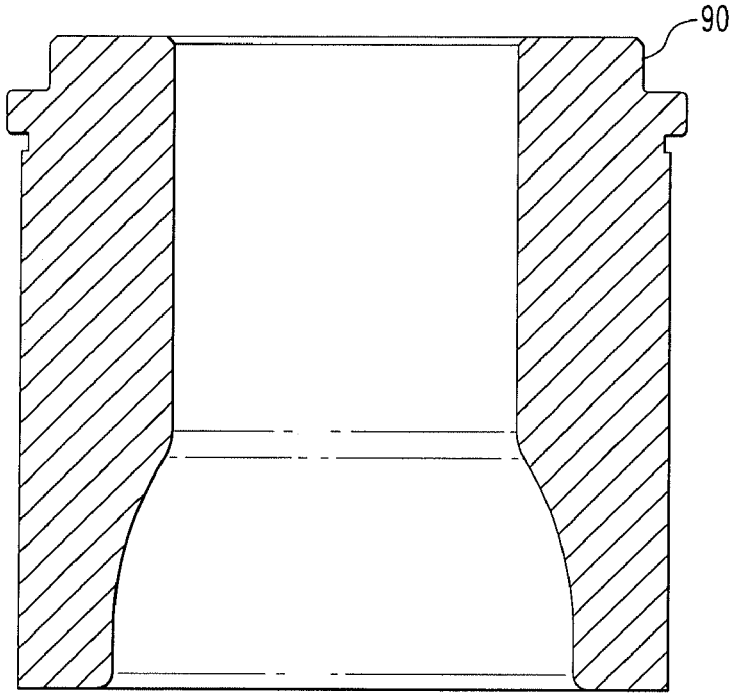
FIG. 4 is a side cross sectional necking die used in accordance with the present invention.

In another aspect of the present invention, a die system for producing shaped beverage containers is provided including the expanding die 5 described in this disclosure. The die system includes at least a first expansion die 5 having a work surface 10 configured to increase a container stock's diameter and to determine the profile at the transition from an original container stock diameter to an expanded portion of the container stock, and at least one progressive expansion die, wherein each successive die in the series of progressive expansion dies has a working surface configured to provide an equal, less than or increasing degree of expansion in the container stock's diameter from the first expansion die. In one embodiment, the die system may also include one or more necking dies. One example of a necking die is depicted in FIG. 4.

In another aspect of the present invention, a method of forming a beverage container is provided. The inventive method may utilize the above described expansion die 5 and includes providing a container stock having a first diameter; expanding at least a portion of the container stock to a second diameter greater than the first diameter with at least one expansion die; and forming an end of the container stock to accept a container lid.

Figure 2A:
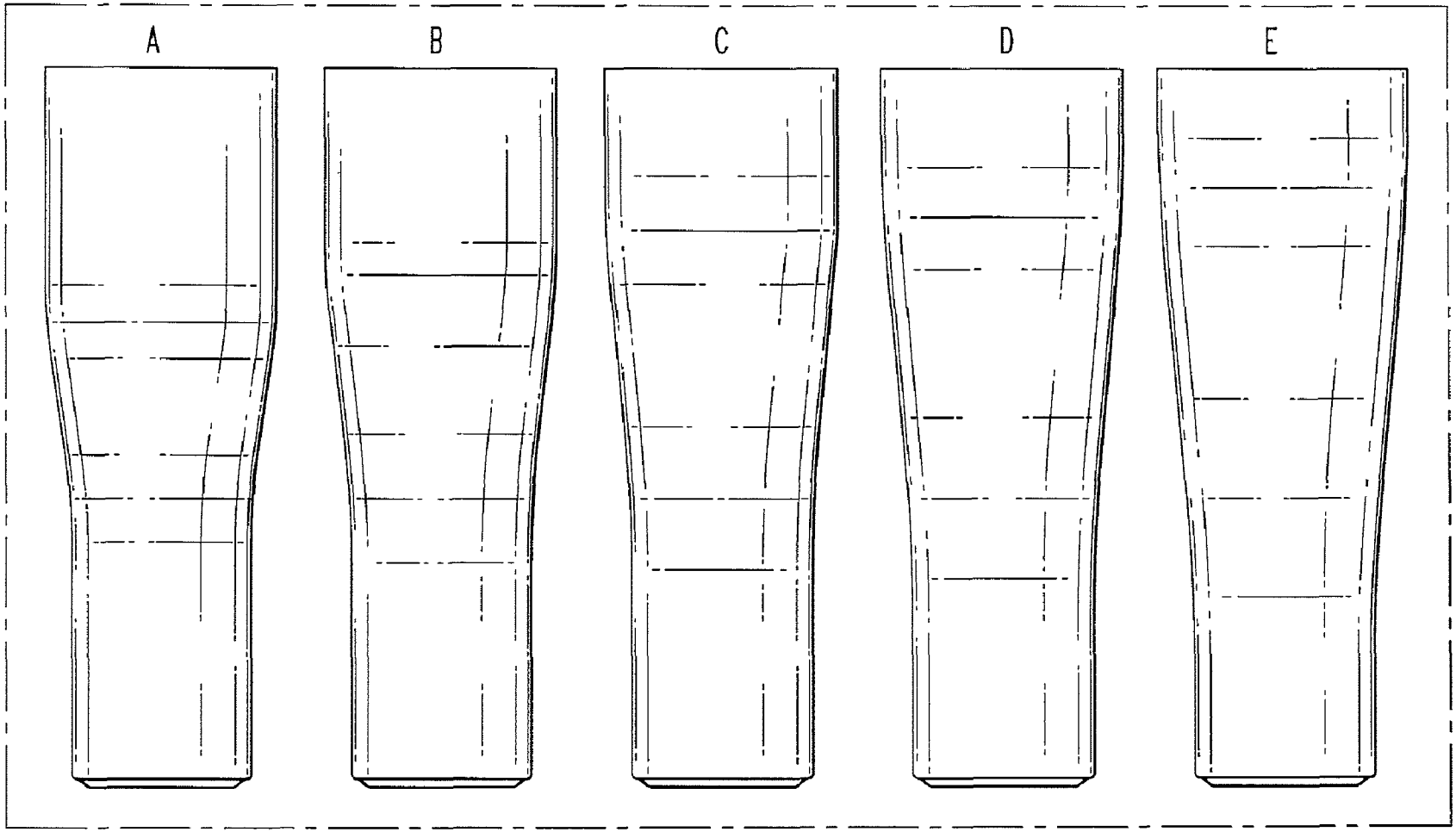
FIGS. 2A, 2B, and 2C are pictorial representations of some embodiments of a 2.069" internal diameter beverage can (beverage container) having at least one portion with a diameter expanded to greater than the diameter of a 211 beverage can using the method in accordance with the present invention.
Figure 2B:
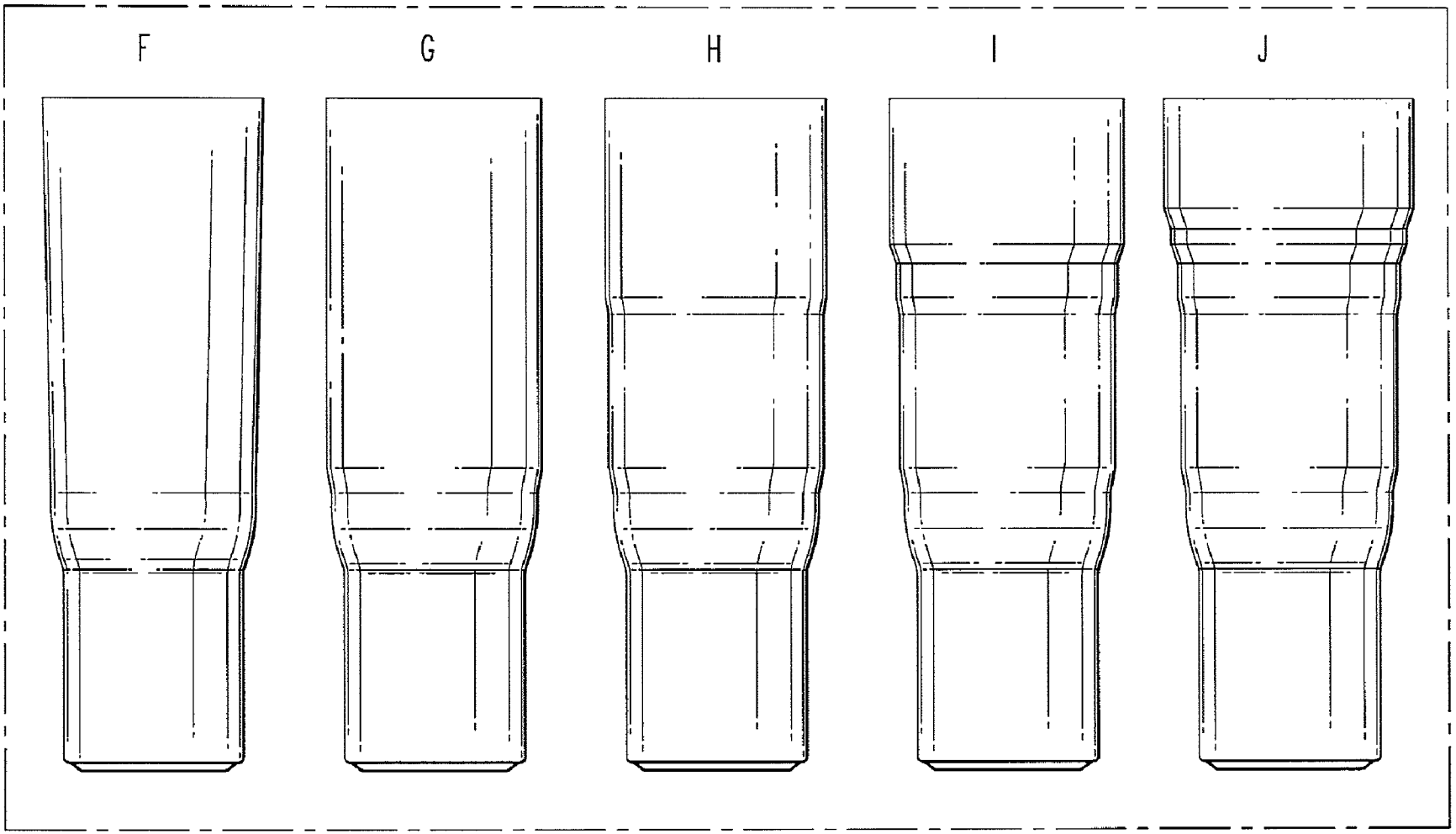
Figure 2C:
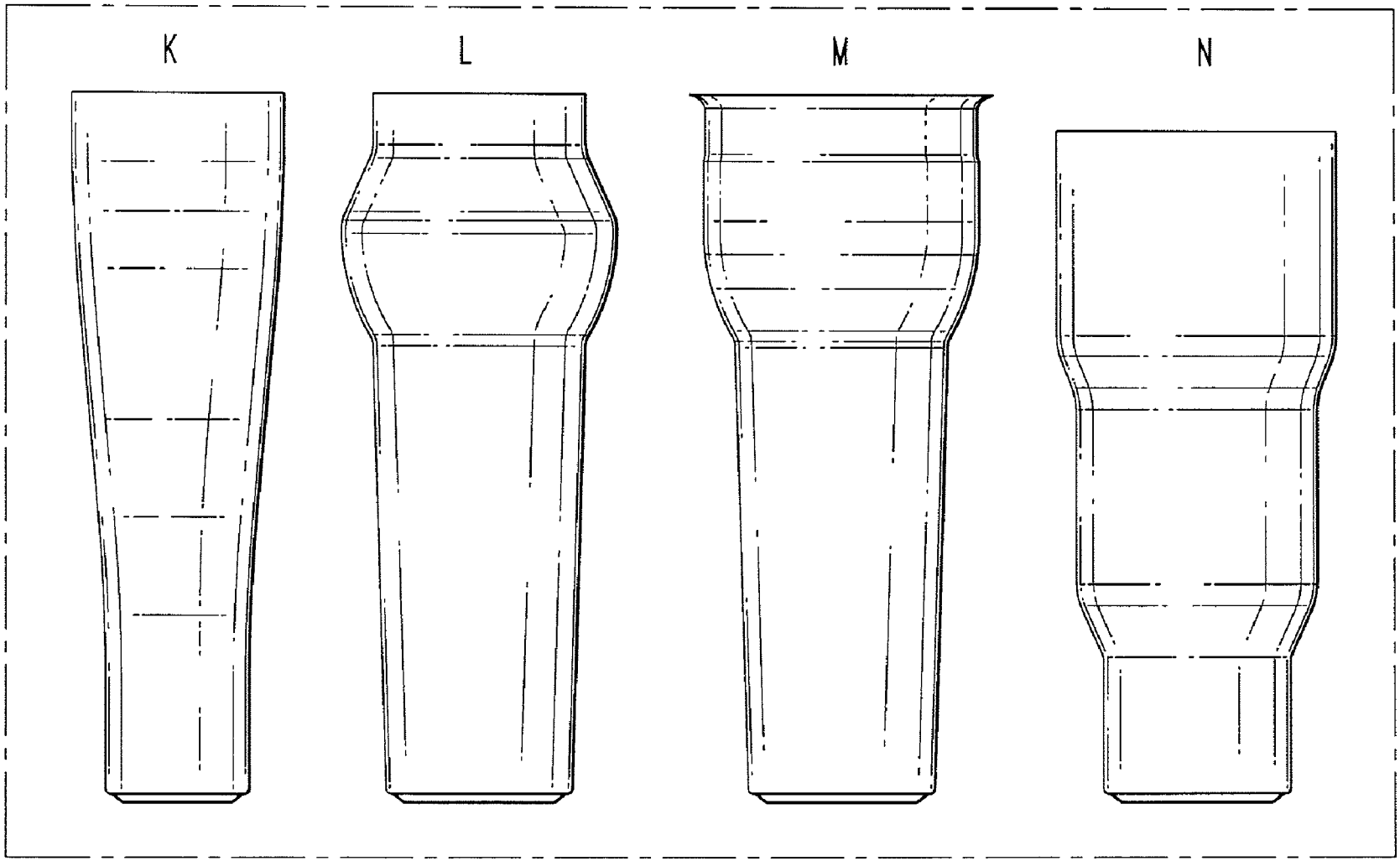
Figure 3:
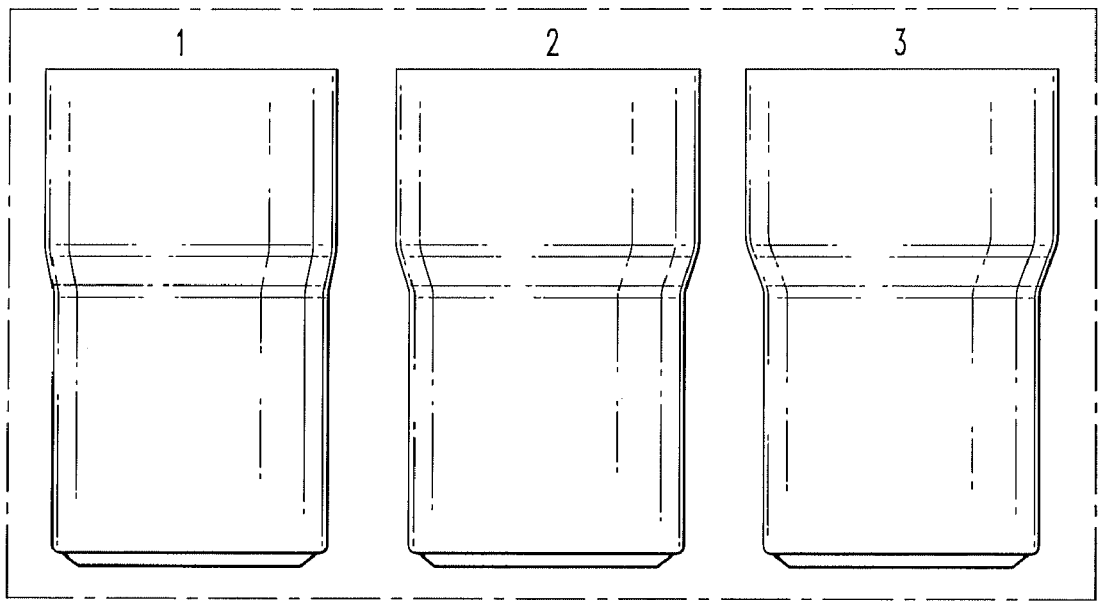
FIG. 3 is a pictorial representations of some embodiments of a 211 beverage can (beverage container) having at least one portion with an internal diameter expanded from a 2.603" diameter to an internal diameter greater than 2.860" using the method in accordance with the present invention.

The term "providing a container stock", as used throughout the present disclosure, is meant to denote providing an aluminum blank, such as a disc or a slug, and shaping the blank into an aluminum container stock. At least one expansion die 5, as described above, is then inserted into the open end of the container stock. The number of expansion die 5 may be dependent on the degree of expansion, the material of the container stock and the sidewall thickness of the container stock. In one embodiment, five expansion die's 5 may be utilized to increase the internal diameter of a container stock from about 2.069" to a diameter greater than the internal diameter of a 211 can, as depicted in FIGS. 2A-2C. In another embodiment, three expansion die may be utilized to expand the internal diameter of a 211 can from about 2.603" to about 2.860", as depicted in FIG. 3. Progressive expansion with the expansion die 5 of the present invention may provide increases in the container's diameter on the order of 25%, wherein greater expansions have been contemplated, so long as the metal is not fractured during expansion.

In one embodiment, the method of forming a beverage container may further include necking the container stock to a third diameter after the expanding of the portion of the container to the second diameter and prior to the forming of the end of the container blank to accept the container lid. Examples L and M depicted in FIG. 2C illustrate necking of an expanded portion of a container stock. Preferably, the third diameter provided by the necking step is less than the second diameter, and the third diameter may be greater than, less than or equal to the first diameter. In one embodiment, the necking process step may be provided by at least one necking die 40, as depicted in. FIG. 4. In one embodiment, the necking process may neck the expanded portion of the container in forming a beverage can or beverage container having a bottle shape.

As opposed to prior necking methods, necking an expanded portion of a container that is formed in accordance with the present invention from the expanded portion to a diameter greater than the container stock's original diameter does not require a knockout because the container's sidewalls are in a state of tension following expansion. In some embodiments, of the present invention a knockout may be used when necking the expanded portion of the container stock to a third diameter. Necking from the expanded portion to less than or equal to the container stock's original diameter typically require a knockout. Preferably, a knockout structure is utilized in necking steps wherein the diameter following necking is less than the container stock's original diameter.

In some embodiments of the present invention, the method of forming a beverage container further includes adjusting a travel dimension of the container stock into the necking die 40 and/or the expansion die 5 to provide a minimized transition between successive expanded portions of the container or between expanded portions and necked portions of the container. The travel dimension is defined as the distance the container stock is displaced along the work surface 10 of the expanding die 5 or necking die 40. One example of the effect of adjusting the travel dimension to provide a minimized transition is depicted in Example L of FIG. 2C. In another embodiment, the travel dimension may be adjusted to provide an elongated transition of substantially uniform diameter between an expanded portion of the container and a necked portion of the container. Examples of a container formed having an elongated transition of substantially uniform diameter include Examples H, I, and J or FIG. 2B, and Example M and N in. FIG. 2C.

The method of the present invention may further include shaping with multiple expanding die 5 sets and necking die 40 sets, which may be used in succession to provide multiple alternating expanded portions and necked portions formed into the container sidewall.

Following the final expansion/necking step the open end of the container stock is formed to accept a container lid. The forming step for attaching a container lid to the open end of the container stock may be any known process or method, including forming a flange, curl, thread, lug, attach outsert and hem, or combinations thereof.

The present invention provides an expansion die 5 and method of forming an expanded portion in the sidewall of a beverage container, therefore advantageously reducing the manufacturing cost associated with shaping beverage containers in beverage container manufacturing.

It is noted that the above disclosure is suitable for beverage, aerosol, food or any other container capable of being expanded and/or necked. Additionally, the above disclosure is equally applicable to drawn and iron, drawn, and impact extrusion shaping/expanding methods.

Although the invention has been described generally above, the following example is provided to further illustrate the present invention and demonstrate some advantages that arise therefrom. It is not intended that the invention be limited to the specific example disclosed.

EXAMPLE 1

Expansion of 2.069" Internal Diameter

A five die expansion system was utilized to expand the diameter of a portion of a container stock having a 0.0088 inch thick sidewall of Aluminum Association (AA) 3104 from an original internal diameter of 2.069" to a final internal diameter on the order of 2.615". The expansion represents an increase of approximately 24% in the container stock's diameter without the formation of Lueder's lines or metal tears. The first expansion die providing an expansion of approximately 9%; the second and third expansion die each providing an expansion of approximately 4.5%; and a fourth and fifth expansion die each providing an expansion of approximately 3.0%.

EXAMPLE 2

Expansion of 2.603" Internal Diameter

A three die expansion system was utilized to expand the diameter of a portion of the container stock of a 211 can having a 0.0056 inch thick sidewall of Aluminum Association (AA) 3104 from an original internal diameter of 2.603" to a final internal diameter on the order of 2.860". In each of the three expansion die the degree of expansion increased by 3% per expansion step.

Having described the presently preferred embodiments, it is to be understood that the invention may be otherwise embodied within the scope of the appended claims.

What is claimed is:

1. An expansion die for manufacturing metal containers comprising:

a work surface configured to expand a diameter of a metal container having a closed bottom, the work surface comprising a progressively expanding portion and a land portion; and an undercut portion;

wherein the land portion is between the progressively expanding portion and the undercut portion and an outer diameter of the land portion is a maximum diameter of the die;

wherein the undercut portion comprises:

(a) an undercut surface; and (b) an outer diameter of the undercut surface, wherein the outer diameter of the undercut surface is :

(i) at least approximately 0.01 inches smaller than the outer diameter of the land portion; and (ii) no less than a minimum diameter so as to reduce but not eliminate frictional contact between the undercut surface and the metal container; and wherein the work surface is dimensioned so that when inserted into the metal container the entire land portion and at least a portion of the undercut portion enter the metal container causing the diameter of the at least a portion of the container to expand.

2. The die of claim 1, wherein an initial portion of the work surface has a geometry for forming a transition in a container from an original diameter portion to an expanded diameter portion.

3. The die of claim 2 wherein the transition is stepped or gradual.

4. The die of claim 1, wherein the land portion has dimensions to provide an expanded diameter of a container stock worked by the work surface.

5. The die of claim 1, wherein at least a portion of the work surface has a surface roughness average (Ra) of approximately 8 μin to 32 μin.

6. The die of claim 1 wherein at least a portion of the undercut portion has surface roughness average (Ra) of approximately 8 μin to 32 μin.

7. A die system comprising:

one or more expansion dies, at least one of the one or more expansion dies comprises:

a work surface configured to expand a diameter of a metal container having a closed bottom, the work surface comprising a progressively expanding portion and a land portion; and an undercut portion;

wherein the land portion is between the progressively expanding portion and the undercut portion and an outer diameter of the land portion is a maximum diameter of the die;

wherein the undercut portion comprises:

(a) an undercut surface; and (b) an outer diameter of the undercut surface wherein the outer diameter of the undercut surface is:

(i) at least approximately 0.01 inches smaller than the outer diameter of the land portion; and (ii) no less than a minimum diameter so as to reduce but not eliminate frictional contact between the undercut surface and the metal container; and wherein the work surface is dimensioned so that when inserted into the metal container the entire land portion and at least a portion of the undercut portion enter the metal container causing the diameter of the at least a portion of the container to expand.

8. The die system of claim 7 further comprising at least one necking die.

9. The die system of claim 7 wherein the outer diameter of the land portion is substantially constant along a length of the land.

10. The die system of claim 7 wherein at least a portion of the work surface has a surface roughness average (Ra) of approximately 8 μin to 32 μin.

11. The die of claim 7 wherein at least a portion of the undercut portion has surface roughness average (Ra) of approximately 8 μin to 32 μin.

* * * * *